United States Patent [19]

Phillips

[11] Patent Number: 4,902,448

[45] Date of Patent: Feb. 20, 1990

[54] CAM AND IDLE SPEED ADJUSTMENT

[75] Inventor: George E. Phillips, Oshkosh, Wis.

[73] Assignee: Burnswick Corporation, Skokie, Ill.

[21] Appl. No.: 306,347

[22] Filed: Feb. 3, 1989

[51] Int. Cl.[4] ..... F02M 1/10

[52] U.S. Cl. ..... 261/65; 74/513; 74/569

[58] Field of Search ..... 261/65; 74/513, 569

[56] References Cited

U.S. PATENT DOCUMENTS

| | | | |
|---|---|---|---|
| 819,202 | 5/1906 | Blackwell | 74/569 |
| 920,042 | 4/1909 | Farley | 74/569 |
| 1,742,843 | 1/1930 | Benedict | 74/568 |
| 2,266,081 | 12/1941 | Rogers | 74/569 |
| 2,925,746 | 2/1960 | Heidner | 74/513 |
| 3,765,671 | 10/1973 | Blomberg | 74/569 |
| 3,770,924 | 11/1973 | Hipple et al. | 74/569 |
| 4,136,649 | 1/1979 | Takahashi | 261/65 |
| 4,262,769 | 4/1981 | Bernoteit et al. | 74/513 |
| 4,317,784 | 3/1982 | Kato et al. | 261/65 |

*Primary Examiner*—Tim Miles

*Attorney, Agent, or Firm*—Robert C. Curfiss

[57] ABSTRACT

A marine carburetor is provided with an adjustment screw mounted on the throttle lever that is engageable with the cam follower in such a manner that movement of the adjustment screw urges the cam follower into engagement with the surface of the throttle cam, at which point continued movement of the screw results in movement of the throttle lever so that the throttle plate may be adjusted to an idle position.

7 Claims, 2 Drawing Sheets

CAM AND IDLE SPEED ADJUSTMENT

BACKGROUND OF THE INVENTION

The present invention relates to a carburetor for a marine engine and more particularly to a single adjustment that controls and adjusts the idle speed and also permits positioning of the throttle cam follower relative to the throttle cam.

Many marine engines utilize a carburetor of the type in which the pivotal movement of a throttle plate mounted on a throttle shaft is controlled by the movement of a throttle lever that is engaged by a cam follower moving along the contoured surface of an operator actuated throttle cam. Carburetors of this type require a number of adjustments in order to operate properly. One such adjustment is the idle speed adjustment in which the throttle plate is moved to a slightly open position to allow a flow of an air/fuel mixture during idle operation. Another such adjustment is the positioning of the cam follower relative to the throttle cam in order to take up any clearances between these two members.

Typically these adjustments were made independently of each other and with separate devices provided on the carburetor. The idle speed adjustment was accomplished by rotating an adjustment screw threaded into the carburetor body which would in turn open the throttle plate. The cam follower adjustment was made by loosening a mounting screw on the cam follower and physically moving the cam follower into engagement with the throttle cam.

The present invention provides a single adjustment located on the throttle lever in the form of a rotatable threaded member. Initial rotation of the threaded member brings the cam follower into engagement with the throttle cam and continued rotation of the threaded member results in a positioning of the throttle plate for an idle speed operation.

Thus the present invention provides a single adjustment for two separate carburetor operations.

SUMMARY OF THE INVENTION

A carburetor of the type in which the pivotal movement of a throttle plate mounted on a throttle shaft is controlled by the movement of a throttle lever engaged by a cam follower moving along the contoured surface of an operator actuated throttle cam includes a single adjustment screw mounted on the throttle lever and engageable with the cam follower so that rotation of the adjustment screw in a first direction urges the cam follower into engagement with the surface of the throttle cam. At this point continued rotation of the adjustment screw results in movement of the throttle lever so that the throttle plate may be adjusted to an idle position.

In accordance with one aspect of the invention, the cam follower is pivotally mounted on the throttle shaft axially inwardly of the throttle lever and is provided with a surface having a notch for engagement with the end of the adjustment screw.

In accordance with another aspect of the invention, the throttle lever and cam follower are provided with stop means that limit the relative movement between the lever and the follower.

BRIEF DESCRIPTION OF THE DRAWINGS

The drawings illustrate the best mode presently contemplated for carrying out the invention.

In the drawings.

DETAILED DESCRIPTION OF THE PREFERRED EMBODIMENT

Figure 1:
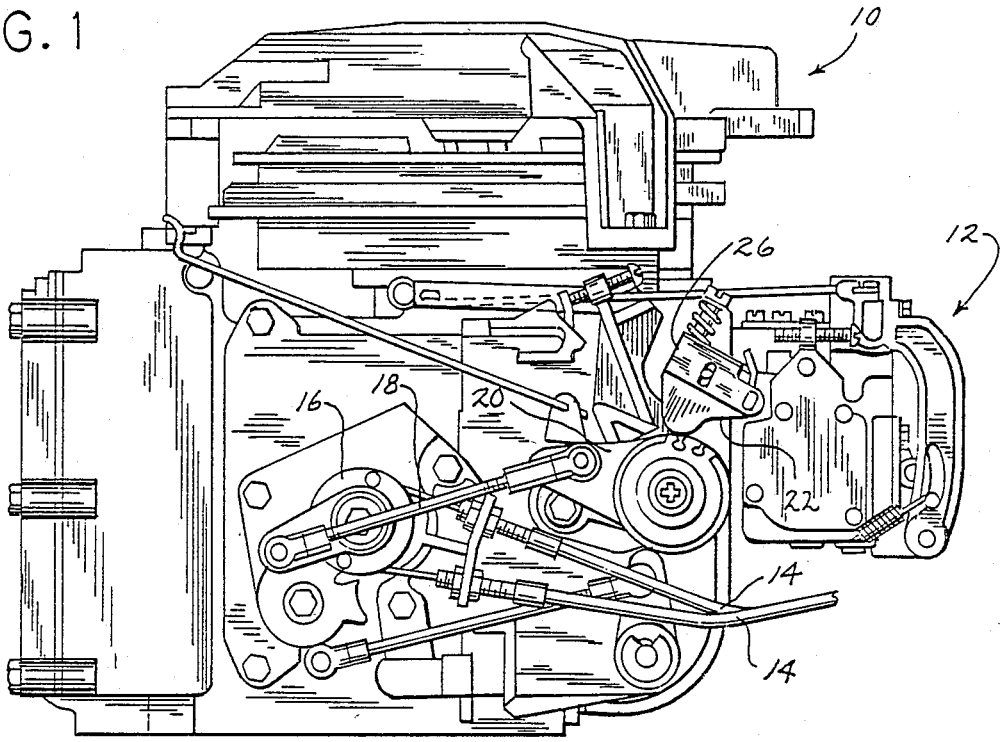
FIG. 1 is a side view of a power head for a marine engine utilizing a carburetor constructed according to the present invention.

FIG. 1 illustrates a marine engine 10 of the type in which the flow of an air/fuel mixture through carburetor 12 is controlled by a tiller handle (not shown) from which extends a pair of tiller cables 14. Movement of tiller cables 14 about pulley 16 results in movement of throttle rod 18 and throttle cam 20.

The movement of cam follower 22 along contoured surface 24 of throttle cam 20 results in rotation of throttle lever 26 and throttle shaft 28 on which it is mounted. This rotation of throttle shaft 28 causes throttle plate 30 to move to an open position so as to increase the flow of the air/fuel mixture through carburetor 12 and into marine engine 10.

Engines and carburetors of this type require a number of adjustments in order for them to operate properly. One such adjustment is movement of cam follower 22 into engagement with throttle cam 20. It is not unusual for there to be a certain amount of clearance between these two members and therefore it is necessary to take up this clearance through an adjustment. Another such adjustment is the movement of throttle plate 30 to a slightly open position for idle speed operation of the engine.

The present invention provides for both of the above adjustments through an adjustment means 32 in the form of an elongated threaded member 34 disposed on throttle lever 26. Throttle lever 26 is in the form of an L-shaped member having a first surface 36 defining a plane substantially perpendicular to the axis of throttle shaft 28 and a second surface 38 defining a plane substantially parallel to the axis of throttle shaft 28 and extending axially inwardly from first surface 36. Threaded member 34 is rotatably disposed within a hole provided in second surface 38 and a spring 40 is seated between surface 38 and notched head 42 in order to provide tension on the threads of member 32 so that member 32 will not be easily rotated by external forces such as the vibrations caused by marine engine 10.

Figure 4:
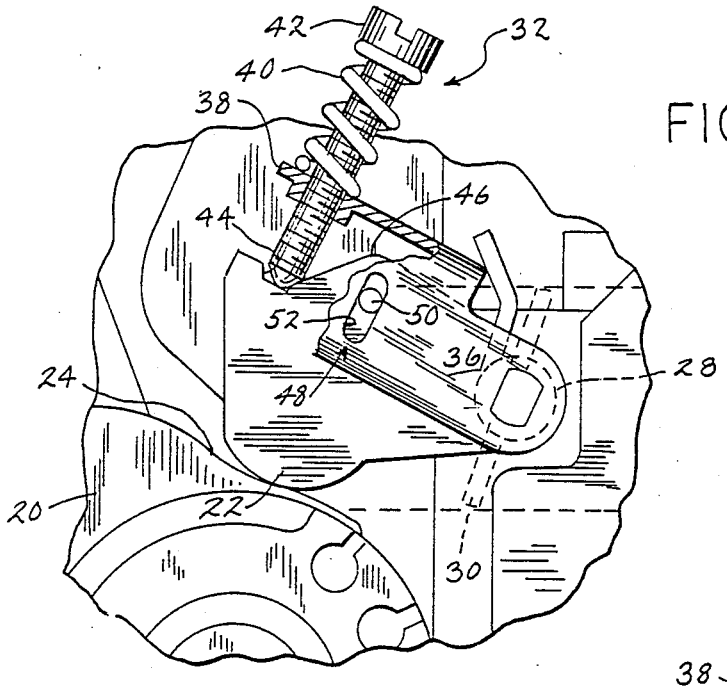
FIG. 4 is a view similar to that of FIG. 2 with the adjustment means rotated in order to bring the cam follower into engagement with the throttle cam.
Figure 5:
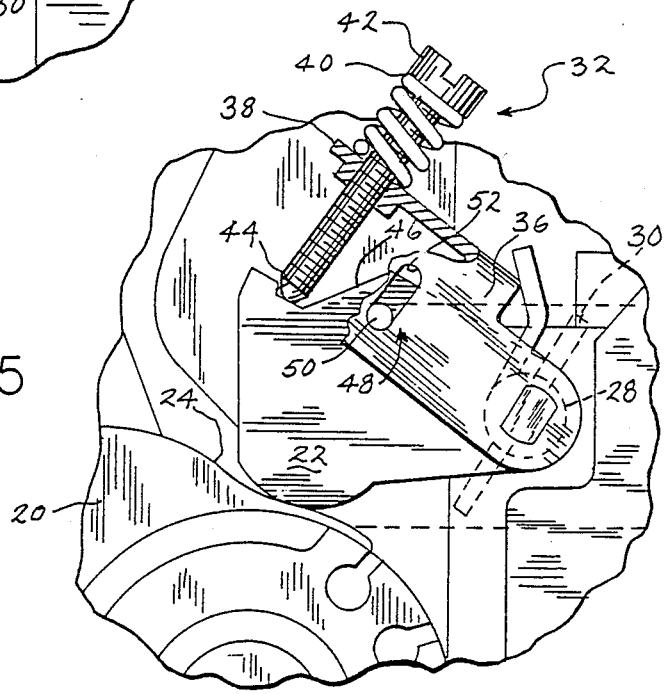
FIG. 5 is a view similar to FIG. 4 with the adjustment means further rotated in order to open the throttle plate to an idle position.
Figure 6:
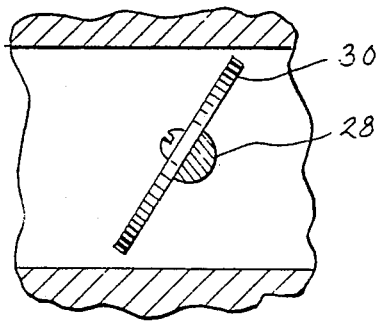
FIG. 6 is a side cross sectional view of the throttle plate in an idle operation position.

As seen in FIGS. 4 and 5, cam follower 22 is provided with a notch 44 in its upper surface 46 for engagement with the end of threaded member 34.

Figure 2:
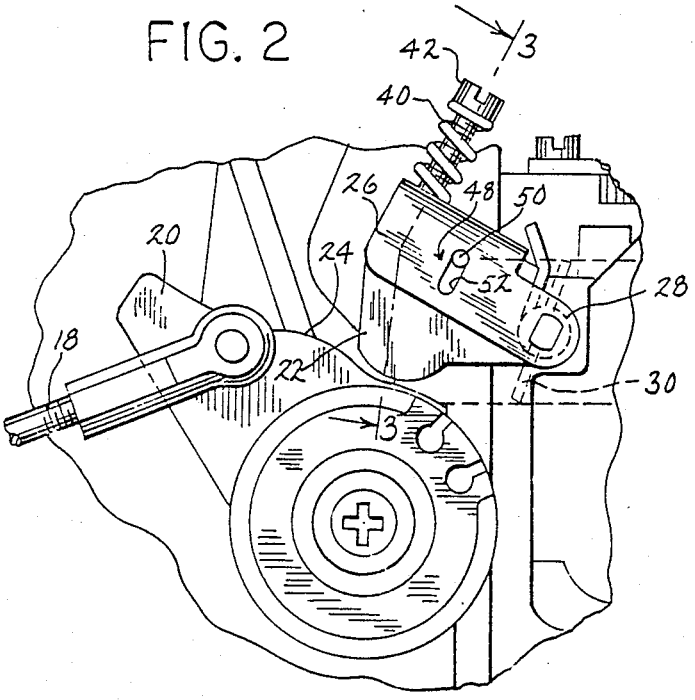
FIG. 2 is an enlarged side view of the cam and idle speed adjustment utilized on the carburetor of FIG. 1.
Figure 3:
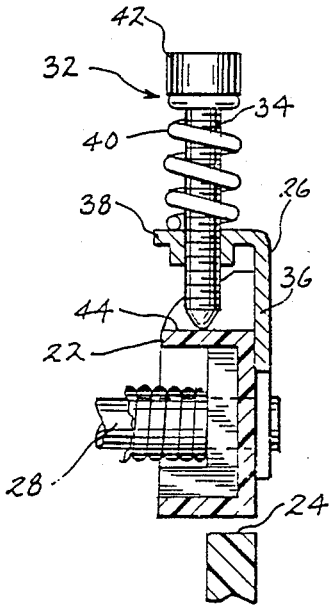
FIG. 3 is a sectional view along the line 3—3 of FIG. 2.

Cam follower 22 is pivotally mounted on throttle shaft 28 axially inwardly of throttle lever 26 and FIG. 2 illustrates a situation in which cam follower 22 is not in engagement with throttle cam 20. In order to take up this clearance, threaded member 34 is rotated to the position shown in FIG. 4 where it has further extended through surface 38 of throttle lever 26 and has forced cam follower 22 into engagement with contoured surface 24 of throttle cam 20.

As shown in FIG. 5, continued rotation of threaded member 34 causes rotation of throttle lever 26 and throttle shaft 28 so that throttle plate 30 is moved to a slightly open position. This slightly open position allows for the idle operation of marine engine 10. Thus, single adjustment means 32 permits for the take-up of any clearance between throttle cam 20 and cam follower 22 and also allows for the adjustment of throttle plate 30 to an idle position.

In order to maintain the relative positions between throttle lever 26 and cam follower 22, a stop means 48 is provided in the form of a boss 50 disposed on the surface of cam follower 22 and extending from the surface and into a slot 52 contained in first surface 36 of throttle lever 26. It can be seen that the relative movement between cam follower 22 and throttle lever 26 is limited to the length of travel of boss 50 within slot 52.

Various modes of carrying out the invention are contemplated as being within the scope of the following claims particularly pointing out and distinctly claiming the subject matter which is regarded as the invention.

I claim:

1. In a marine carburetor of the type in which the pivotal movement of a throttle shaft mounted throttle plate is controlled by the movement of a throttle lever engaged by a cam follower pivotally mounted on the throttle shaft and moving along the contoured surface of an operator actuated throttle cam, a combined cam and idle speed adjustment comprising, adjustment means mounted on the throttle lever and engagement with a notch disposed on the surface of the cam follower so that movement of said adjustment means in a first direction urges the cam follower into engagement with the surface of the throttle cam, at which point continued movement of said adjustment means in said first direction results in movement of the throttle lever so that the throttle plate may be adjusted to an idle position.

2. The cam and idle speed adjustment defined in claim 1 wherein said adjustment means comprises an elongated threaded member rotatably disposed within a hole on the throttle lever.

3. The cam and idle speed adjustment defined in claim 2 wherein the throttle lever comprises an L-shaped member having a first surface defining a plane substantially perpendicular to the axis of the throttle shaft and having a second surface defining a plane substantially parallel to the axis of the throttle shaft and extending axially inwardly from said first surface with said threaded member mounted on and extending through said second surface.

4. The cam and idle speed adjustment defined in claim 1 further comprising stop means operatively connected between the throttle lever and the cam follower to limit the relative movement between the lever and the follower.

5. The cam and idle speed adjustment defined in claim 4 wherein said stop means comprises a boss disposed on and extending from a surface of the cam follower and a boss-containing slot disposed in the throttle lever so that the length of said slot defines the extent of relative travel between the throttle lever and the cam follower.

6. In a marine carburetor of the type in which the pivotal movement of a throttle shaft mounted throttle plate is controlled by the movement of a throttle lever engaged by a cam follower pivotally mounted on the throttle shaft and moving along the contoured surface of an operator actuated throttle cam, a combined cam and idle speed adjustment comprising, an elongated threaded member rotatably disposed within a hole on the throttle lever and having and end engageable with a notch disposed on the surface of the cam follower so that relation of the threaded member in a first direction urges the cam follower into engagement with the surface of the throttle cam, at which point continued rotation of said threaded member results in movement of the throttle lever so that the throttle plate may be adjusted to an idle position, and stop means operatively connected between the throttle lever and the cam follower to limit the relative movement between the lever and the follower.

7. In a marine carburetor of the type in which the pivotal movement of a throttle shaft mounted throttle plate is controlled by the movement of a throttle lever engaged by a cam follower pivotally mounted on the throttle shaft and moving along the contoured surface of an operator actuated throttle cam, a combined cam and idle speed adjustment comprising, adjustment means comprising an elongated threaded member rotatably disposed within a hole on the throttle lever and engageable with a notch disposed on the surface of the cam follower so that movement of said adjustment means in a first direction urges the cam follower into engagement with the surface of the throttle cam, at which point continued movement of said adjustment means in said first direction results in movement of the throttle lever so that the throttle plate may be adjusted to an idle position.

* * * * *